US006257838B1

(12) United States Patent
Schlossarczyk et al.

(10) Patent No.: US 6,257,838 B1
(45) Date of Patent: Jul. 10, 2001

(54) GAS COMPRESSOR

(75) Inventors: Heinrich Schlossarczyk, Wennigsen; Karl-Heinrich Schönfeld, Seelze; Jens Tiedemann, Gehrden, all of (DE)

(73) Assignee: WABCO GmbH, Hannover (DE)

( * ) Notice: Subject to any disclaimer, the term of this patent is extended or adjusted under 35 U.S.C. 154(b) by 0 days.

(21) Appl. No.: 09/418,900

(22) Filed: Oct. 15, 1999

(30) Foreign Application Priority Data

Oct. 31, 1998 (DE) ..... 198 50 269

(51) Int. Cl.[7] ..... F04B 49/00
(52) U.S. Cl. ..... 417/280; 417/275
(58) Field of Search ..... 417/306, 439, 417/296, 280, 279, 298, 307, 275, 36, 32; 137/599; 251/301

(56) References Cited

U.S. PATENT DOCUMENTS

| | | | | |
|---|---|---|---|---|
| 4,249,866 | * | 2/1981 | Shaw et al. | 417/280 |
| 4,412,788 | * | 11/1983 | Shaw et al. | 417/280 |
| 4,993,922 | * | 2/1991 | Lauterbach et al. | 417/279 |
| 5,101,857 | | 4/1992 | Heger et al. . | |
| 5,452,989 | * | 9/1995 | Rood et al. | 417/29 |
| 5,503,537 | * | 4/1996 | Schlossarczyk et al. | 417/296 |
| 5,796,184 | * | 8/1998 | Kuhnll et al. | 307/118 |
| 5,803,711 | * | 9/1998 | Schoenmeyr | 417/36 |
| 5,885,060 | * | 3/1999 | Cunkelman et al. | 417/243 |
| 6,026,587 | * | 2/2000 | Cunkelman et al. | 34/53 |

FOREIGN PATENT DOCUMENTS

| | | |
|---|---|---|
| 32 14 713 | 10/1983 | (DE) . |
| 33 29 790 | 2/1985 | (DE) . |
| 43 21 013 | 1/1995 | (DE) . |

* cited by examiner

*Primary Examiner*—Teresa Walberg
*Assistant Examiner*—Daniel Robinson
(74) *Attorney, Agent, or Firm*—Proskauer Rose LLP

(57) ABSTRACT

A gas compressor for vehicle braking systems controlled by compressed air can be operated under load or in idle operation. In idle operation, no compressed air is produced. In operation under load, the gas compressor produces compressed air as required by the pressure medium installation. During prolonged operation of the gas compressor at a relatively high operating speed, for example, during travel on super-highways, the power consumption can be decreased and thereby also the production amount of the gas compressor, without having to switch the gas compressor over into idle operation. A clearance volume of less volume than the nominal volume of the gas compressor is provided which can be connected via a valve to the compression chamber of the gas compressor, thereby making it possible to enlarge the compression volume. In addition, a process for the control of the auxiliary valve takes into account different operating magnitudes of the gas compressor and other elements of the vehicle.

26 Claims, 3 Drawing Sheets

GAS COMPRESSOR

BACKGROUND OF THE INVENTION

The invention relates to a gas compressor which can be switched between operation under load and operation in idle, and more particularly, a gas compressor of the type in which a suction chamber can be connected via at least one suction valve to a compression chamber and an outlet chamber can be connected via at least one outlet valve to the compression chamber.

A gas compressor of this type is disclosed, for example, in German patent DE 43 21 013 (U.S. Pat. No. 5,503,537), incorporated herein by reference.

Gas compressors of known construction generally include a compression chamber in which a movable compression element, i.e. a striking piston, alternately draws in the gas to be compressed and then compresses it. In order to achieve efficient performance in the output of compressed gas, the best utilization of the volume of the compression chamber is generally desirable. For this reason, it is general practice to keep the volume of the compression chamber remaining in the compression phase and which cannot be utilized, which is also referred to as the "dead space," to a minimum.

When a gas compressor which is optimized in this manner is operated under load, a sufficient amount of compressed gas may be produced by the gas compressor even at relatively low rotational speeds. However, when the gas compressor is operated at a variable operating speed, for example, when connected to the drive engine of a vehicle, the output quantity may be undesirably great during extended operation at high rotational drive speeds, for example, when traveling on a super-highway. In such instances, the gas compressor has a relatively high power consumption, which results, among other things, in an undesirable heating of both the gas compressor itself and the compressed gas produced thereby. To overcome this situation, it is often not practical to switch the gas compressor to idle operation, because compressed gas is no longer produced in this operating mode.

It is therefore the object of the present invention to make it possible to reduce the power consumption occurring under certain operating conditions in a gas compressor under load operated at variable operating speed, and thereby also to reduce the temperatures that are produced in this manner.

SUMMARY OF THE INVENTION

In accordance with these and other objects of the invention, there is provided a gas compressor switchable between operation under load and operation in idle. The gas compressor includes a compression chamber, a suction chamber, an outlet chamber. At least one suction valve is provided, via which the suction chamber can be selectively connected to the compression chamber. In addition, at least one outlet valve is also provided, via which the outlet chamber can be selectively connected to the compression chamber. The gas compressor in accordance with the invention includes an auxiliary clearance volume and at least one auxiliary valve via which the auxiliary clearance volume can be connected to the compression chamber. The auxiliary valve is actuatable in response to an actuating signal which is derived from at least one of the operating magnitudes of the gas compressor occurring in operation under load or from a device connected to the gas compressor.

The invention provides the advantage of permitting the power consumption to be adapted to the current need for compressed gas in a gas compressor of any design, independently of the applicable operating principle applied, with the exception of dynamic type compressors. In addition, a rise in temperature of the gas compressor and the compressed gas due to dissipated energy can thus be avoided. The invention provides further advantage by reducing the occurrence of pressure surges and pulsation noises. By virtue of reduced vibration, the service life of the compressor is effectively extended.

It is yet another advantage of the invention that the actuating signal for actuating the auxiliary valve, which serves to connect the compression chamber to the auxiliary clearance volume, can be derived from a plurality of different operating magnitudes of the gas compressor, or from a device associated therewith, for example, a pressure medium installation supplied by the gas compressor which is connected to the gas compressor. In a preferred manner, a link between different operating magnitudes or operating states can also be effected thereby.

In an advantageous embodiment of the invention, the auxiliary valve is provided in the form of an elastic, deformable part of a seal installed in the gas compressor. The auxiliary valve can thus be produced with particular ease and economy. Furthermore, no additional labor is required for the assembly of the auxiliary valve.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
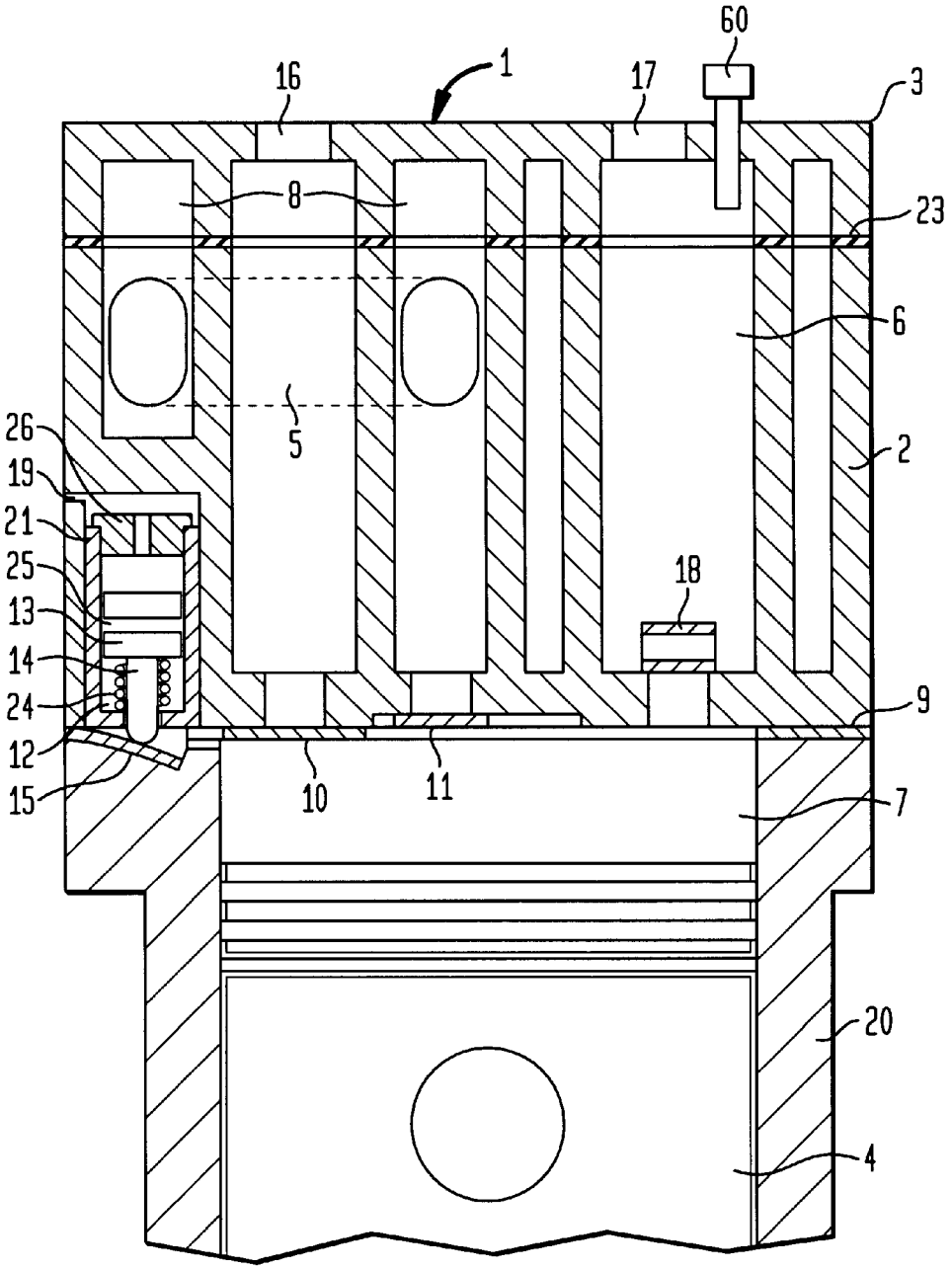
FIG. 1 is a cross-sectional view of a gas compressor of piston-type design.

Referring now to the figures, and in particular FIG. 1, a gas compressor of piston design is depicted in cross-section, generally designated by the reference numeral 1. Gas compressor 1 includes a cylinder 20 and a piston 4 movable within the cylinder 20. Movement of the piston 4 is effected by a rotatable drive shaft (not shown) via a connecting-rod drive (also not shown). A cylinder head comprising an upper part 3 and a lower part 2 is attached to the cylinder 20. A seal 9 is provided between the cylinder head 2, 3 and the cylinder 20 to maintain air-tightness. An additional seal 23 is located between the upper part 3 and the lower part 2 of the cylinder head.

A suction chamber 5, which can be connected directly via a suction connection 16, or via a conduit, to the surrounding atmosphere or to a turbo-supercharger of a combustion engine, is located in the cylinder head 2, 3. In this application, the gas used is air. The suction chamber 5 can be connected to a compression chamber 7 via a suction valve 10, provided, as shown, in the form of a bending elastic check valve of lamellar design. The boundary of the compression chamber 7 is defined by the cylinder 20, the piston 4, and the cylinder head 2, 3 or the seal 9. The volume of the compression chamber 7 can be changed by movement of the piston 4, i.e. from a nominal volume which occurs when the piston 4 is at its lower dead center, and a design-based clearance volume which occurs when the piston 4 is at its upper dead center.

The compression chamber 7 can be connected via an outlet valve 18 to an outlet chamber 6 located in the cylinder head 2, 3. The outlet chamber 6 can, in turn, be connected to a pressure medium installation of, for example, a vehicle, via a pressure medium line (not shown) connected to an outlet connection 17.

The compression chamber 7 can furthermore be connected via an auxiliary valve 15 to an auxiliary clearance volume 12. In accordance with an advantageous embodiment of the invention, the auxiliary valve is provided in the form of a bendable elastic part of the seal 9. An auxiliary piston 13 with a piston rod 14, acting mechanically upon the auxiliary valve 15, is provided for actuation of the auxiliary valve 15. The auxiliary piston 13 moves in a longitudinal direction within a piston guide 21. The auxiliary piston 13 can be placed under pressure via a control connection 19, and can thus actuate the auxiliary valve 15, so that a connection is established between the compression chamber 7 and the auxiliary clearance volume 12. When the auxiliary piston 13 is not subjected to pressure, it is moved back into its starting position by means of a spring 24 which biases the auxiliary piston with the additional assistance of the above-mentioned bending elastic effect of the auxiliary valve 15, which is in the form of part of the seal 9. This movement is restricted by a stop 26 located on the side of the auxiliary piston 13 away from the piston rod 14.

Figure 2:
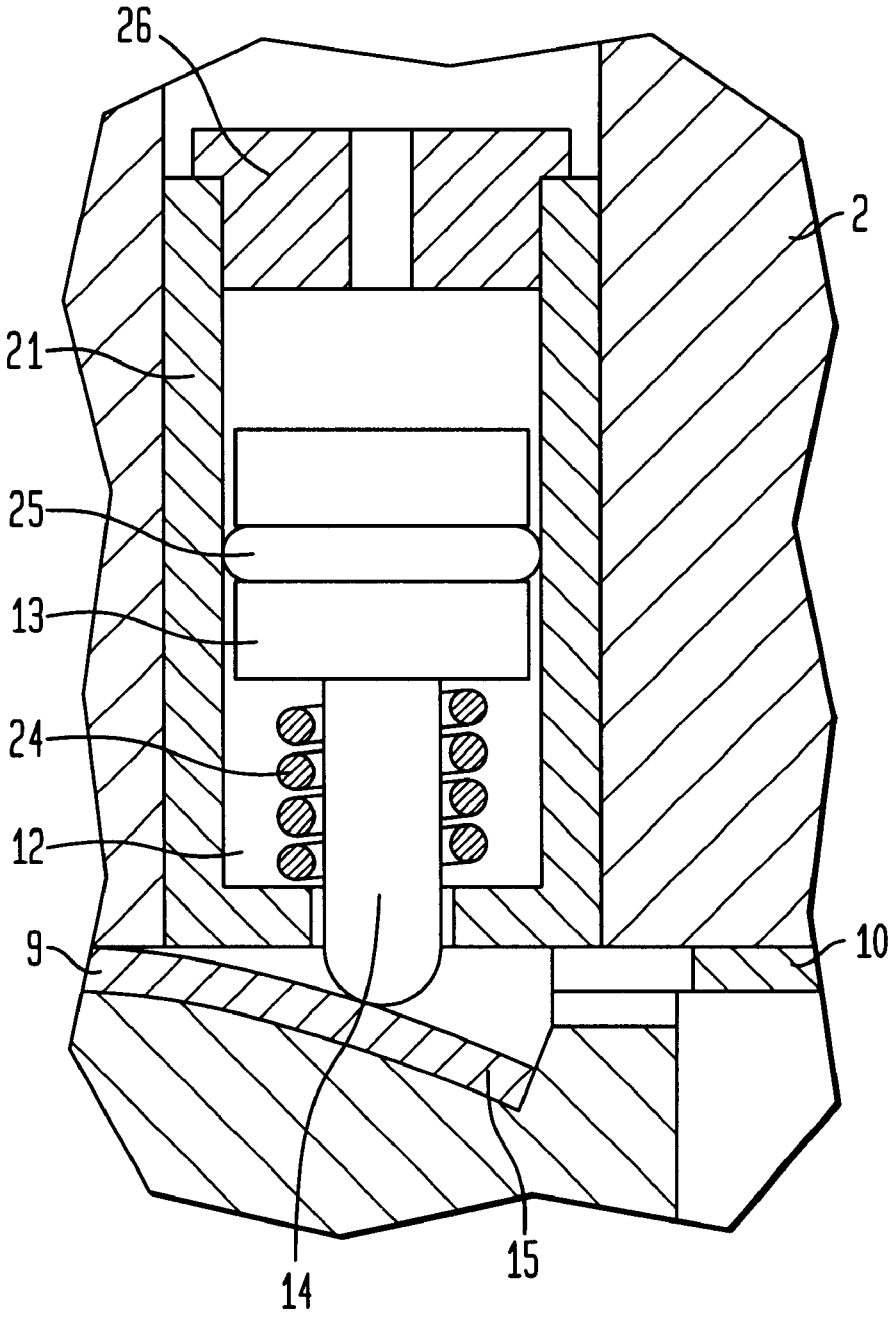
FIG. 2 is a detailed view of the gas compressor of FIG. 1.

Turning now to FIG. 2, a detailed view of the gas compressor 1 is depicted in an enlarged scale, highlighting, in particular, the action of the auxiliary valve 15. In both Figs. 1 and 2, the auxiliary valve 15 is shown in an open state, having been actuated as a result of the auxiliary piston 13 being subjected to pressure. When the pressure on the auxiliary piston 13 is relieved, the auxiliary piston is moved back into its starting position in the direction of the stop 26 by the biasing force of the spring 24, with the assistance of the bending elastic nature of the auxiliary valve 1S. At the same time, the auxiliary valve 15 closes, due to its bending elastic nature.

In addition, the compression chamber 7 can be connected via an additional valve 11 to an additional chamber 8, which surrounds the suction chamber 5 in the depicted example of FIG. 1. The auxiliary clearance volume 12 is integrated by design into the additional chamber 8, but is separated in a pressure-fast manner from the additional chamber 8 by a wall. The additional valve 11 can be moved by means of a horizontal switching piston (not shown) from the closed position shown in FIG. 1, into an open position. This switching piston can be subjected to pressure via another control connection (not shown in FIG. 1). The switching piston thus opens the additional valve 11 when subjected to pressure. The functioning of the additional valve 11 and the switching piston are described in detail, for example, in German patent DE 39 04 172 A1, which is incorporated herein by reference.

A temperature sensor 60 is provided in the upper part 3 of the cylinder head in proximity to the outlet chamber 6. A measuring tip of the temperature sensor 60 extends into the outlet chamber 6 for the purpose of determining the temperature of the compressed air therein, and the temperature sensor 60 emits an electrical signal. In accordance with an advantageous embodiment of the invention, described in further detail below, the actuation of the auxiliary valve 15 is controlled by means of this signal.

The gas compressor described above operates in the following manner under load. For purposes of description, it is assumed that the piston 4 is initially at its upper dead center, whereby the compression chamber 7 exhibits its smallest volume. By drive the gas compressor via the drive shaft, as well as the connecting-rod drive, the piston 4 is moved in the direction of its lower dead center, which, at first results in creation of a negative pressure in the compression chamber 7, i.e. a pressure difference is formed between the compression chamber 7 and the suction chamber 5. This pressure difference causes the bending elastic suction valve 10 to open, thereby initiating air flow from the suction chamber 5 into the compression chamber 7. Upon reaching the lower dead center, the piston 4 moves in the opposite direction, until it reaches its upper dead center. At the same time, the air accumulated thus far in the compression chamber 7 is compressed, thereby creating a higher pressure in the compression chamber 7 than in the suction chamber 5. This causes the suction valve 10 to close. The pressure increases in the compression chamber 7, ultimately reaching and exceeding the pressure in the outlet chamber 6, which, until then, has held the outlet valve 18 in a closed state. As the pressure in the outlet chamber 6 is exceeded, the outlet valve 18 opens as a result of the pressure in the compression chamber 7, and compressed air flows from the compression chamber 7 into the outlet chamber 6.

The above-described process is repeated several times until sufficient pressure, also referred to as "nominal pressure," prevails in the pressure medium installation connected to the gas compressor 1. When the nominal pressure is reached, the gas compressor, which was running until then under load, is switched to idle run.

To set the operating mode of the gas compressor at a given time, a distinction is made in automotive technology between "pressure regulator control" and "governor control." If pressure regulator control is applied, in idle the outlet connection 17 is connected to a relief space which is free of over-pressure, i.e. the atmosphere. If governor control is applied in idle, the compression chamber 7 is customarily connected to the suction chamber 5, for example, by holding the suction valve 10 in an open state by means of a pressure-medium-actuated switching piston.

In accordance with the particular embodiment of a governor control used in the present example, the compressed-air production of the gas compressor is suppressed in idle operation by a considerable enlargement of the effective clearance volume of the gas compressor, such that even during a compression stroke, no pressure exceeding the pressure in the outlet chamber 6 can be produced in the compression chamber 7. In order to switch over to idle and concomitantly reduce the power consumption of the gas compressor 1, the additional valve 11 is therefore actuated, connecting the compression chamber 7 to the additional chamber 8. The effective clearance volume is thereby enlarged to a considerable degree, i.e. by the size of the additional chamber 8. The additional chamber 8 advantageously has a volume of approximately 10 percent to 100 percent of the nominal volume of the compression chamber 7, so that only a relatively minor rise in pressure occurs in the compression chamber in idle operation, and the outlet valve 18 remains permanently closed. Reference is made to the state of the art (DE 43 21 013 A1 mentioned above) with respect to the action of the additional chamber in idle operation.

In certain operating states when the gas compressor 1 operates under load, for example, in the event of considerable heating up of the gas compressor or when the engine drive the gas compressor 1 is under great load, it may be necessary to adapt the power consumption and thereby also the delivery of pressure medium to these operating conditions, i.e. to decrease them slightly without switching over to the idle operating state in which no pressure medium is supplied. For this purpose, the auxiliary valve 15 is then actuated by means of the auxiliary piston 13 via the piston rod 14, and the compression chamber 7 is thereby connected to the auxiliary clearance volume 12. The auxiliary clearance volume 12 has a relatively smaller volume in comparison with the compression chamber 7, preferably about 5% to about 20% of the volume of the compression chamber 7.

Figure 3:
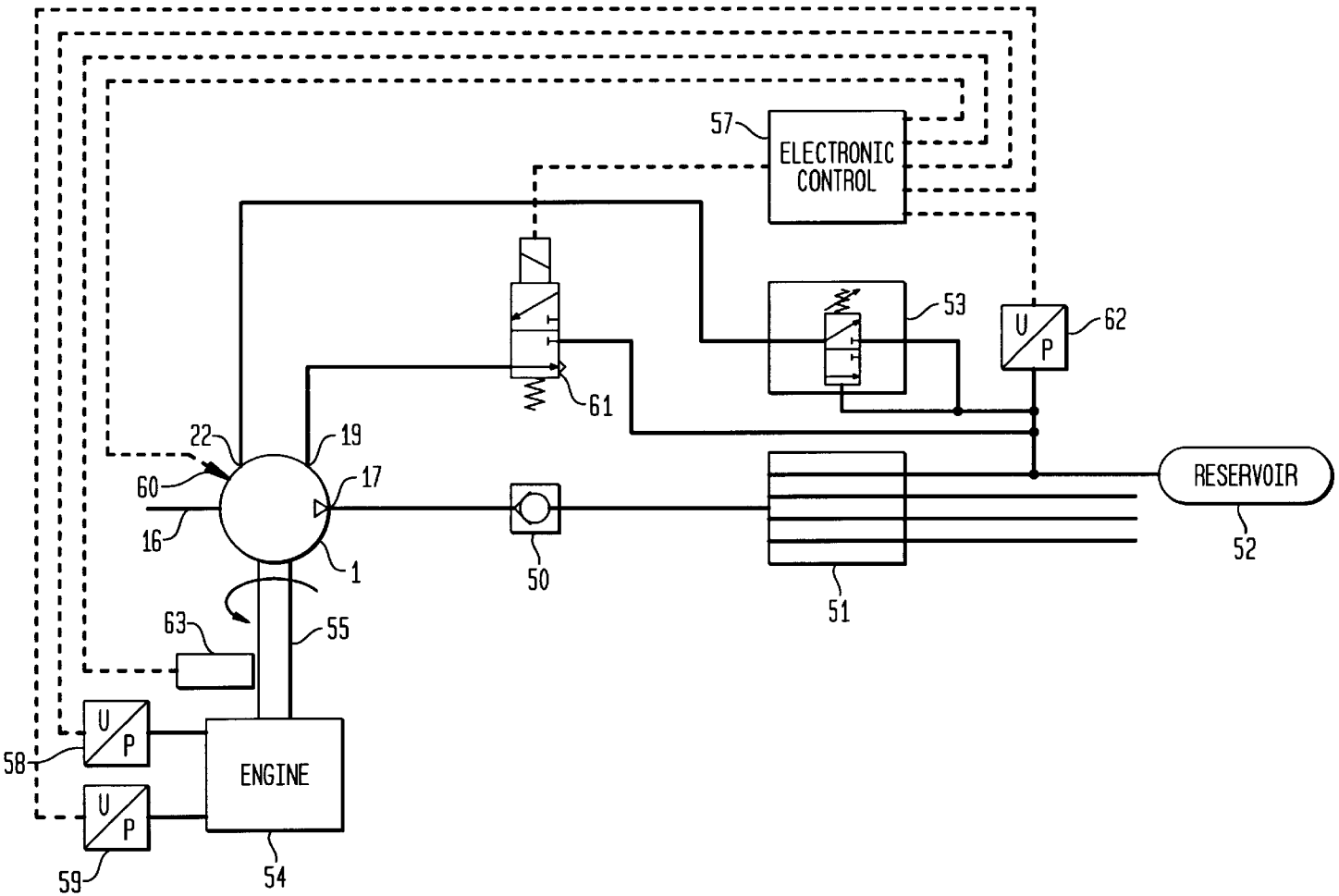
FIG. 3 is a schematic view of an embodiment of a pressure medium supply for a vehicle with a gas compressor according to FIG. 1, in which pressure medium lines are depicted as continuous lines and electrical lines are depicted as broken lines.

Referring now to FIG. 3, a pressure medium installation employing the gas compressor 1 of the type presented in FIG. 1 is schematically depicted, and which includes the suction connection 16 connected to the surrounding atmosphere, the outlet connection 17 for the compressed air, the control connection 19 which can be subjected to the pressure medium for actuation of the auxiliary valve 15. The gas compressor 1 of FIG. 3 further includes an additional control connection 22 which can be subjected to a pressure medium for the actuation of the additional valve 11. The gas compressor 1 is driven via a drive shaft 55 by an engine 54. The engine 54 is preferably the drive engine of a vehicle in which the pressure medium installation functions.

The engine 54 is connected permanently and tightly via the drive shaft 55 to the gas compressor 1. The gas compressor 1 is therefore always driven at the rotational speed of the engine. This rotational speed is subject to great variations, particularly in a vehicle.

The gas compressor 1 supplies different pressure medium circuits with compressed air via a check valve 50 connected to the outlet connection 17, and a multi-circuit safety valve 51 connected thereto. Of these pressure medium circuits, FIG. 3 shows a compressed-air reservoir 52 as an example. Compressed-air consumers, and which are not shown in FIG. 3, are furthermore connected to the compressed-air reservoir 52.

The gas compressor 1 can be operated under load when pressure medium is required in one of the pressure medium circuits. In such event, the gas compressor supplies additional compressed air. When no additional compressed air is temporarily needed in the pressure medium circuit because sufficient pressure is present, the gas compressor can be operated in idle. In this operating state, it does not supply compressed air into the pressure medium circuits.

The governor control for the setting of the operating modes of load and idle is applied in FIG. 3. For this purpose, a governor 53 is provided, and which is connected on an input side thereof to the compressed-air reservoir 52. The governor 53 emits a pressure signal on an output side thereof, which is transmitted via a line to the control connection 22 of the gas compressor 1 when a predetermined shut-off pressure, for example, 8.5 bar is reached. In the presence of a corresponding pressure signal at the control connection 22, the compression chamber 7 is connected via the additional valve 11 to the additional chamber 8. As a result, the gas compressor 1 is then in idle state operation. The governor 53 permits the pressure signal after exceeding the shut-off pressure, and continues to emit the pressure signal until the pressure drops below a switching pressure, for example, 7.5 bar in the compressed-air reservoir 52. By virtue of the hysteresis between the shut-off pressure and the switching pressure, a constant alternation between the operating conditions of load and idle is effectively avoided.

The pressure medium installation according to FIG. 3 additionally includes a series of sensors which serve to transform certain operating magnitudes of the pressure medium installation into electrical signals, and thus make it possible to determine these operating magnitudes of the pressure medium installation. The sensors consist of a pressure sensor 58 for sensing an over-pressure produced by a turbo-charger which is assigned to the engine 54, a pressure sensor 59 for sensing a negative pressure representing the stress imposed on the engine 54, the aforementioned temperature sensor 60 which determines the temperature of the compressed air, a pressure sensor 62 for sensing the pressure in the compressed-air reservoir 52, and a rotational-speed sensor 63 for sensing the operating speed of the gas compressor 1.

The above-mentioned sensors are connected via an electrical line to an evaluating device, provided in the form of an electronic control unit 57. The electronic control unit 57 processes the signals of these sensors in accordance with a process, in the form of a control program which will be explained in further detail below. As a result of the processing of the sensor signals, the electronic control unit 57 produces an electrical output signal which is transmitted via an electrical line to a solenoid valve 61 connected to the electronic control unit 57. The solenoid valve 61 is provided in the form of a 3/2 way valve and therefore has two switched positions. The solenoid valve 61 can also be integrated into the gas compressor 1.

The solenoid valve 61 is connected to the compressed-air reservoir 52 and the control input 19 of the gas compressor 1 on the side towards the compressed-air reservoir 52. In the first switching position of the solenoid valve 61, as shown in FIG. 3, the magnetically operated valve is not actuated as a consequence of an output signal to that effect coming from the electronic control unit 57. In this case, the solenoid valve 61 connects the control input 19 to the atmosphere, so that the auxiliary valve 15 is also not actuated. When the magnet of the solenoid valve 61 receives an actuating signal from the electronic control unit 57, the solenoid valve 61 overcomes a biasing force and assumes its second switched position. The solenoid valve 61 thereby connects the outlet connection 17 to the control input 19, causing the auxiliary valve 15 to be opened, such that the compression chamber 7 is connected to the auxiliary clearance volume 12. As a result, the power consumption of the gas compressor 1 is reduced, and furthermore, pressure peaks are decreased in the pressure chamber 6.

The following is a description of the process for the evaluation of the signals of the sensors 58, 59, 60, 62, 63 used to obtain the actuating signal for the solenoid valve 61.

For purposes of the description, it is assumed that the solenoid valve 61 is initially non-actuated. When at least one of the following conditions is met, the solenoid valve 61 is actuated by the electronic control unit 57 through emission of an actuating signal:

- The temperature value determined by the sensor 60 exceeds a first temperature limit value.
- The turbo-charger pressure value exceeds a pressure limit value.
- The engine negative pressure value drops below a predetermined negative-pressure limit value for a minimum time period.
- The rotational speed value sensed by the sensor 63 exceeds a limit rotational speed value for a given time period.

The above-mentioned actuating signal for the solenoid valve 61 is, however, not produced, or is immediately switched off, under the above-mentioned conditions if it is detected in the electronic control unit 57 that the pressure value, i.e. the supply pressure sensed by the pressure sensor 62 falls below a minimum pressure value. This condition is thus given priority over the conditions mentioned above.

Another condition superseding the conditions mentioned above occurs when the temperature value sensed by the sensor 60 exceeds a second temperature limit value which is greater than the first temperature limit value. In such event, production of an actuating signal for the solenoid valve 61 is consistently maintained. In this manner, a failure of the gas compressor due to continued overload and the excessive heat caused thereby is effectively avoided. In the operating state when the solenoid valve 61 is actuated, i.e. with the addition of the auxiliary clearance volume 12, the gas compressor can be operated for greatly extended periods of time without danger of failure, whereby at least a sufficient pressure supply is maintained in the compressed-air reservoir 52 in order to brake the vehicle.

It is intended that the above-mentioned limit values for temperature, pressure or negative pressure and rotational speed are to be empirically determined through tests as a function of the gas compressor and drive engine of the particular vehicle used. Periods of one to ten minutes are especially well suited as minimum periods for the failure to reach the negative pressure limit value and for the excess of the rotational speed limit value.

Having described preferred embodiments of the invention with reference to the accompanying drawing, it is to be understood that the invention is not limited to those precise embodiments, and that various changes and modifications may be effected therein by one skilled in the art without departing from the scope or spirit of the invention as defined in the appended claims.

What is claimed is:

1. A gas compressor swichable between operation under load and operation in idle, comprising:

a compression chamber;

a suction chamber, and at least one suction valve via which the suction chamber can be selectively connected to the compression chamber;

an outlet chamber, and at least one outlet valve via which the outlet chamber can be selectively connected to the compression chamber;

structure defining an auxiliary clearance volume connectable to the compression chamber when the gas compressor is operating under load, wherein the auxiliary clearance volume is significantly smaller in volume than the compression chamber; and at least one auxiliary valve via which the auxiliary clearance volume can be connected to the compression chamber, the auxiliary valve being actuatable in response to an actuating signal which is derived from at least one operating magnitude of the gas compressor occurring in operation under load or from a device connected to the gas compressor.

2. A gas compressor according to claim 1, further comprising:

an additional chamber; and an additional valve via which the additional chamber can be selectively connected to the compression chamber.

3. A gas compressor according to claim 1, wherein the auxiliary clearance volume is about 5% to about 20% of a volume of the compression chamber.

4. A gas compressor according to claim 2, wherein the additional chamber has a greater volume than the auxiliary clearance volume.

5. A gas compressor according to claim 2, wherein a volume of the additional chamber is about 10% to about 100% of a volume of the compression chamber.

6. A gas compressor according to claim 1, wherein the actuating signal for actuation of the auxiliary valve is produced when a predetermined operating speed of the gas compressor is exceeded.

7. A gas compressor according to claim 1, wherein the actuating signal for actuation of the auxiliary valve is produced when the gas compressor produces more than a predetermined amount of compressed air during a fixed time period.

8. A gas compressor according to claim 1, wherein the actuating signal for actuation of the auxiliary valve is produced when a predetermined operating temperature of the gas compressor or of a device connected to the gas compressor is exceeded.

9. A gas compressor according to claim 1, wherein the actuating signal for actuation of the auxiliary valve is produced when a predetermined operating temperature of a device connected to the gas compressor is exceeded.

10. A gas compressor according to claim 1, wherein the actuating signal for actuation of the auxiliary valve is produced when a predetermined pressure value of a pressure medium installation supplied by the gas compressor is exceeded.

11. A gas compressor according to claim 1, wherein the gas compressor is drivable by an engine, and the actuating signal for action of the auxiliary valve is produced in response to increased load of the engine.

12. A gas compressor according to claim 11, wherein the engine is a drive engine of a vehicle.

13. A gas compressor according to claim 12, wherein said increased power consumption is the result of uphill travel of the vehicle.

14. A gas compressor according to claim 1, wherein the actuating signal for actuation of the auxiliary valve is produced with time delay only after a condition calling for actuation thereof has existed for at least a predetermined period of time.

15. A gas compressor according to claim 1, wherein the auxiliary valve can be actuated by a pressure medium.

16. A gas compressor according to claim 15, wherein the pressure medium is provided by a pressure medium installation supplied by the gas compressor.

17. A gas compressor according to claim 15, wherein the pressure medium is provided by a turbo-charger.

18. A gas compressor according to claim 15, wherein the pressure medium is provided by environmental pressure.

19. A gas compressor according to claim 1, wherein the auxiliary valve can be actuated by a pressure medium, the pressure medium being supplied from an electrically actuated valve to the auxiliary valve.

20. A gas compressor according to claim 1, wherein the auxiliary valve can be actuated electrically.

21. A gas compressor according to claim 20, further comprising a sensing device which produces an electrical signal.

22. A gas compressor according to claim 21, wherein the actuating signal for actuation of the auxiliary valve is the electrical signal received directly from the sensing device.

23. A gas compressor according to claim 21, wherein the sensing device includes at least one device selected from the group consisting of a rotational speed sensor, a temperature sensor, a pressure sensor and an air moisture sensor.

24. A gas compressor according to claim 21, further comprising an evaluation device which processes the electronic signal and produces an electrical output signal, the actuating signal for actuation of the auxiliary valve being said electrical output signal produced by the evaluation device.

25. A gas compressor according to claim 1, further comprising a seal installed in the gas compressor, the auxiliary valve being defined by an elastic deformable part of said seal.

26. A gas compressor according to claim 25, further comprising:

a cylinder head including structure at least partially defining the suction chamber, the outlet chamber, and the auxiliary clearance volume;

a cylinder including structure at least partially defining the compression chamber; and said seal being provided between the cylinder head and the cylinder to maintain air-tightness therebetween.

* * * * *

UNITED STATES PATENT AND TRADEMARK OFFICE

CERTIFICATE OF CORRECTION

PATENT NO. : 6,257,838 B1
DATED : July 10, 2001
INVENTOR(S) : Heinrich Schlossarczyk It is certified that error appears in the above-identified patent and that said Letters Patent is hereby corrected as shown below:

Column 8,
Line 35, should read -- signal actuation of the auxiliary valve is produced in --

Signed and Sealed this

Twenty-eighth Day of May, 2002

*Attest:*

*Attesting Officer*

JAMES E. ROGAN
*Director of the United States Patent and Trademark Office*